US007644953B2

(12) United States Patent
Groves

(10) Patent No.: US 7,644,953 B2
(45) Date of Patent: Jan. 12, 2010

(54) HAMMER-DRIVEN SNOW POLE

(75) Inventor: Brad Groves, Rockford, IL (US)

(73) Assignee: Fiberglass Innovations, LLC, Rockford, IL (US)

( * ) Notice: Subject to any disclaimer, the term of this patent is extended or adjusted under 35 U.S.C. 154(b) by 0 days.

(21) Appl. No.: 11/328,844

(22) Filed: Jan. 10, 2006

(65) Prior Publication Data

US 2006/0169195 A1 Aug. 3, 2006

Related U.S. Application Data

(60) Provisional application No. 60/645,090, filed on Jan. 19, 2005.

(51) Int. Cl.
*A63C 11/00* (2006.01)

(52) U.S. Cl. ..... 280/821; 280/819; 52/103

(58) Field of Classification Search ..... 280/809, 280/812, 813, 819, 821, 826; 404/9, 10, 404/11; 403/109.5, 377; 116/63 C, 63 R, 116/63 P; 52/103, 156, 162

See application file for complete search history.

(56) References Cited

U.S. PATENT DOCUMENTS 1,950,298 A * 3/1934 Frost ..... 52/103
2,779,240 A * 1/1957 Gaydos ..... 404/9
3,279,133 A * 10/1966 De Korte ..... 52/103
3,378,967 A * 4/1968 Baumeister ..... 52/103
3,507,081 A * 4/1970 Gallup ..... 52/103
3,916,821 A * 11/1975 Pies ..... 52/103
4,270,873 A * 6/1981 Laehy et al. ..... 404/10
4,343,567 A * 8/1982 Sarver et al. ..... 403/109.5
4,486,117 A * 12/1984 Blau ..... 404/10
4,502,258 A * 3/1985 Rushing ..... 52/103
4,977,851 A * 12/1990 Anderson ..... 403/109.5
5,029,783 A * 7/1991 Alvarez ..... 248/146
5,090,348 A * 2/1992 Hugron ..... 116/63 P
5,207,175 A * 5/1993 Andonian ..... 52/103
5,291,703 A * 3/1994 Ziegler ..... 52/103
5,507,589 A * 4/1996 Jacobs ..... 404/11
5,624,210 A * 4/1997 Baldwin et al. ..... 405/232
6,514,006 B1 * 2/2003 Hines ..... 404/9

* cited by examiner

*Primary Examiner*—Hau V Phan
(74) *Attorney, Agent, or Firm*—Stoll Keenon Ogden PLLC; David J. Clement; Justin M. Tromp

(57) ABSTRACT

A marker pole for embedding in a support medium for drawing attention to potentially hazardous subsurface structures within the support medium includes a generally elongate pole body molded from a generally brightly colored plastic material with a penetrating end formed with a tapered tip for insertion into the support medium, the taper being greater than forty-five degrees from a centerline longitudinal axis of the; and a metal impact cap fitted over the distal end, the impact cap including a generally cylindrical body having an access opening on one end thereof and a substantially planar surface opposing the access opening, the planar surface being in substantial contact with the upper surface of the pole body for enhanced force transmission between the impact cap and the pole body during insertion of the pole into the support medium using an impact producing tool.

16 Claims, 3 Drawing Sheets

HAMMER-DRIVEN SNOW POLE

CROSS-REFERENCE TO RELATED APPLICATION

The present application claims the benefit of U.S. Provisional Patent Application Ser. No. 60/645,090 titled "Hammer-Driven Snow Pole" filed Jan. 19, 2005.

BACKGROUND OF THE INVENTION

The present invention relates broadly to ground-supported safety markers and more particularly, to a snow pole that is highly visible and includes a hammer drive cap for enhanced ground insertion capabilities.

Snow poles and posts provide durable, positive guidance in snowy conditions. They also provide an inexpensive and effective visible warning.

Snow poles provide a visible position marker that can give skiers advanced warning of closed runs and approaching hazards, thereby adding an extra margin of safety for skiing. In addition, a snow pole or pole could be placed near a subsurface stump or other obstacle also warning of a hidden danger.

The prudent use of snow poles can also reduce damage to fixed objects during street plowing operations. There, snow poles provide advance warning to plow operators, alerting them to the locations of fixed objects such as guardrails and fire hydrants. Effective positioning of snow poles can safely show the plow operator where to plow, and, perhaps more importantly, where not to plow. Such poles can provide a margin of safety that reduces replacement cost of both the plow and the object identified by the snow pole.

Snow poles are generally inexpensive thin rods that extend from three to four feet in length. Their diameter is typically on the order of one-quarter to one-half inch. Since the body of the snow pole is typically formed from plastic or fiberglass, the result is a lightweight, flexible pole that can be thrust into the snow. In order to enhance the snow penetration ability of the pole, the snow contact surface is tapered like a pencil end, albeit with a much steeper and shorter slope. Conventional snow poles typically have a rubber cap at the opposite end from the taper. This cap typically protects the end surface of the snow pole.

Snow poles are versatile and have many applications that include marking culverts, locating junction boxes, marking fire hydrants, setting snowmobile race courses, marking cross-country ski trails, supporting banners and signs, securing snow fencing, delineating lift lines, and as a school crosswalk flag holder. Further, the snow poles may also be inserted in the ground to provide warning of underground pipes or other structures. One of the problems associated with such poles and which may arise when dealing with crusty snow, is the difficulty of ground or snow penetration by the snow pole in a manner that is quick and can insure positive penetration in snow or in ground placement.

There currently exists a need for a simple snow pole that will be operable effectively with a hammer or other driving implement for enhanced snow penetration capabilities.

SUMMARY OF THE INVENTION

It is accordingly an object of the present invention to provide a snow pole with the ability to be effectively hammer- or implement-driven into snow, the ground, or other support medium.

It is another object of the present invention to provide such a snow pole that offers high visibility, even under adverse conditions.

Generally, the present invention includes a pole body formed as an elongate structure from plastic, fiberglass, or other lightweight, weather-resistant material. The body is approximately 3 to 4-feet long and one-quarter to one-half inch in diameter. A tapered tip is formed at one portion of the body for ground or snow insertion. The tapered portion of the tip is relatively short and steep.

The opposite end of the body is generally flat or may be formed with a rough surface such as may be left by mold.

An impact cap is attached to the pole body at an end opposite from the tapered end. The impact cap is formed from metal and includes a generally cylindrical body having an opening at one end and a flat nail-head surface at the other. The opening provides access to the interior of the cylinder whose diameter is slightly larger than the diameter of the snow pole such that the snow pole end fits snugly within the cylinder.

The flat, nail-head surface is attached at its perimeter to the cylindrical body of the end cap. The nail-head surface presents a flat contact surface for a hammer or other driving implement that distributes the impact force evenly over the pole such that the end cap remains substantially undeformed and the snow pole is swiftly driven into the support medium.

The pole body of present invention may also include a fluorescent or other brightly colored outer surface, such as fluorescent green. The brightly colored, fluorescent surface provides high contrast visibility under adverse conditions which may include blowing and drifting snow. The present invention is described in greater detail below.

The present snow pole can be described more generally as a marker pole. More specifically, the present invention provides a marker pole for embedding in a support medium for drawing attention to potentially hazardous subsurface structures within the support medium, the marker pole including a generally elongate pole body having a penetrating end and a distal end, the penetrating end formed with a tapered tip for insertion into the support medium, with the distal end being formed with a generally planar upper surface; an impact cap fitted over the distal end, the impact cap including a generally cylindrical body having an access opening on one end thereof and a substantially planar surface opposing the access opening, the planar surface being in substantial contact with the upper surface of the distal end of the pole body for enhanced force transmission between the impact cap and the distal end of the pole body during insertion of the pole into the support medium using an impact producing tool.

Preferably, the pole body is formed from a generally plastic material and wherein the impact cap is formed from a hard material. The pole body may also be molded from generally plastic material, wherein the plastic material is chosen from the group consisting of polymers and fiberglass. Further, the generally plastic material may be fluorescent for high visibility under adverse conditions.

It is preferred that the impact cap is formed from metal and includes a generally undeformable flat head structure, in the manner of a nail-head. In addition, the penetrating end may be formed with a taper greater than forty-five degrees from a centerline longitudinal axis of the pole body.

The marker pole may also be described as a marker pole for embedding in a support medium for drawing attention to potentially hazardous subsurface structures within the support medium, the marker pole including a generally elongate pole body having a penetrating end and a distal end, the penetrating end formed with a tapered tip for insertion into the support medium, with the distal end being formed with a generally planar upper surface, the pole body being formed with a brightly colored finish for increased visibility under adverse visual conditions; and an impact cap fitted over the distal end, the impact cap including a generally cylindrical body having an access opening on one end thereof and a substantially planar surface opposing the access opening, the planar surface being in substantial contact with the upper surface of the distal end of the pole body for enhanced force transmission between the impact cap and the distal end of the pole body during insertion of the pole into the support medium using an impact producing tool.

It is preferred that the pole body is formed from a generally plastic material and wherein the impact cap is formed from a hard material. Further, the pole body may be molded from the generally plastic material, wherein the plastic material is chosen from the group consisting of polymers and fiberglass. It is preferred that the generally plastic material is fluorescent, thereby providing a brightly colored finish for high visibility under adverse conditions.

Preferably, the impact cap is formed from metal and includes a generally undeformable flat head structure. It is further preferred that the penetrating end is formed with a taper greater than forty-five degrees from a centerline longitudinal axis of the pole body.

Another variation of the present invention may be described as a marker pole for embedding in a support medium for drawing attention to potentially hazardous subsurface structures within the support medium, the marker pole including a generally elongate pole body molded from a generally plastic material and having a penetrating end and a distal end, the penetrating end formed with a tapered tip for insertion into the support medium, the taper being greater than forty-five degrees from a centerline longitudinal axis of the pole body with the distal end being formed with a generally planar upper surface, the pole body being formed with a brightly colored finish for increased visibility under adverse visual conditions; and a metal impact cap fitted over the distal end, the impact cap including a generally cylindrical body having an access opening on one end thereof and a substantially planar surface opposing the access opening, the planar surface being in substantial contact with the upper surface of the distal end of the pole body for enhanced force transmission between the impact cap and the distal end of the pole body during insertion of the pole into the support medium using an impact producing tool.

Preferably the pole body is molded from the generally plastic material, wherein the plastic material is chosen from the group consisting of polymers and fiberglass. It is further preferred that the generally plastic material is fluorescent, thereby providing a brightly colored finish for high visibility under adverse conditions. Preferentially, the metal impact cap includes a generally undeformable flat head structure.

By the above, the present invention provides an improved marker pole, which may function as a snow pole that includes enhanced ease of use and decreases the deployment time for multiple marker poles, in addition to providing a high visibility pole for times when visibility is low.

DESCRIPTION OF THE PREFERRED EMBODIMENT

Figure 1:
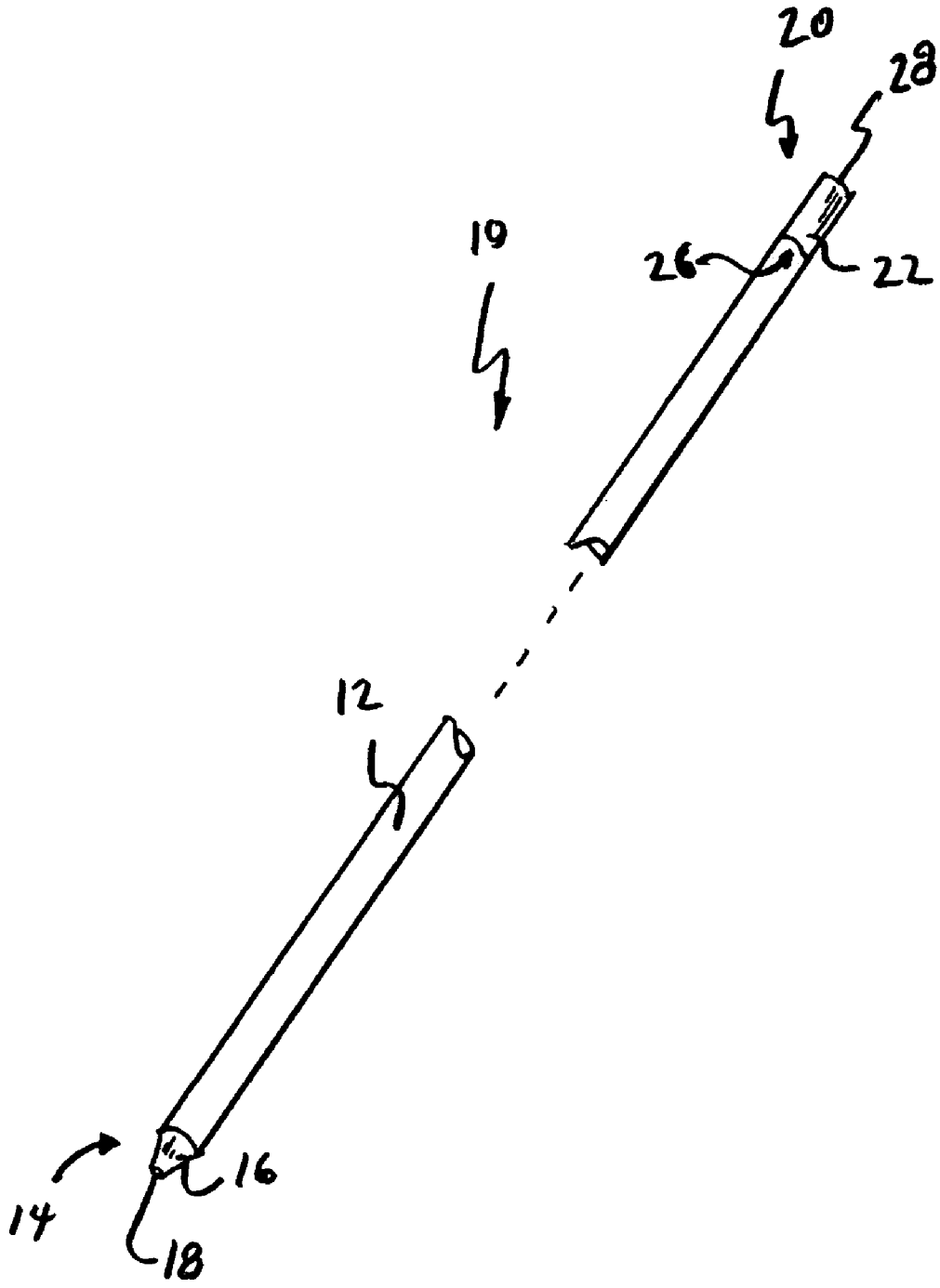
FIG. 1 is a perspective view of a snow pole according to the preferred embodiment of the present invention.
Figure 2:
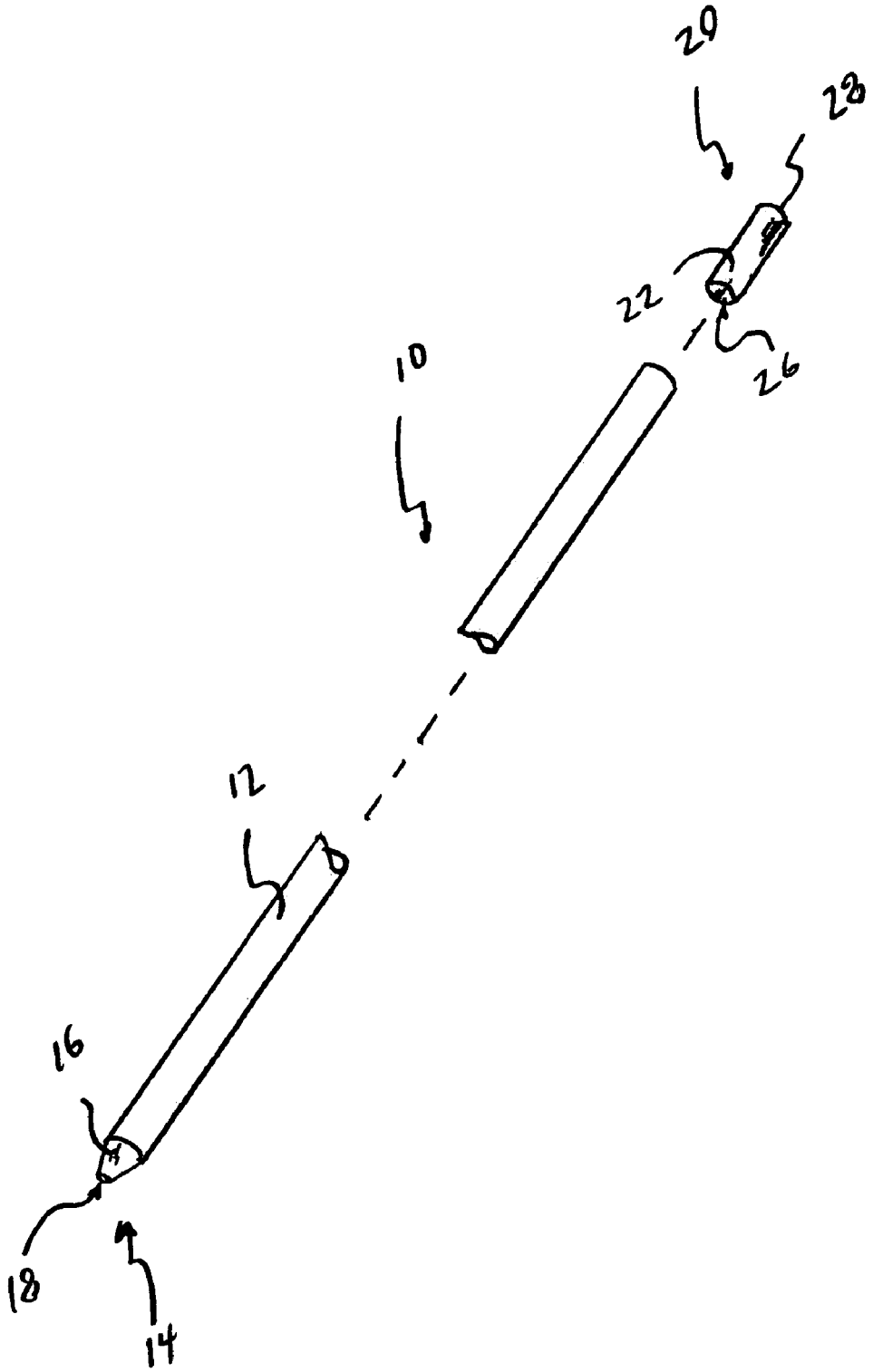
FIG. 2 is an exploded view of the snow pole illustrated in FIG. 1.

Turning now to the drawings and, more particularly to FIG. 1, a hammer-driven snow pole according to a preferred embodiment of the present invention is illustrated generally at 10 and includes an elongate, thin body 12 formed from fiberglass, plastic or other lightweight, resilient and weather-resistant material extending along a longitudinal axis A thereof. The material optionally may be brightly colored so as to be fluorescent, and may be green, orange, yellow, or some other high visibility color. The fluorescent surface provides high visibility for the snow pole in adverse weather conditions, or under other conditions that limit visibility.

It should be understood that while the present application discusses the invention in terms of being hammer-driven, any implement may be used to drive the present snow pole into the support medium such as snow or ground. A blunt instrument achieves the best force distribution over the nail-head cap, as more fully explained hereinafter, but other objects may be used as needed.

The body 12 includes a penetrating end as defined by a tapered end portion 14 having generally conical walls 16 and a pointed tip 18 for snow or ground insertion, and extends along the generally longitudinal axis A thereof. The tapered tip 18 provides a small pressure surface for snow or ground contact to thereby enhance the ability of a user to force the snow pole into the snow or ground. Further, the relative bluntness of the pole piles up snow ahead of the pole more rapidly that a more gradual taper and therefore helps to prevent over-insertion of the pole. The slope of the tapered tip forms an angle of greater than 45 degrees with the longitudinal axis A of the body 12.

An impact cap 20 is provided at the end opposite the tapered end portion 14 and includes a cylindrical wall 22 defining an internal cavity 24 and an access opening 26 into which the distal end of the pole body 12 projects. A generally flat end panel 28, or nail-head is formed integrally with the cylindrical walls to ultimately form the impact cap 20. As seen in the Figures, the impact cap 20 is fitted to the pole body 12 in a snug, friction-fitting manner.

Figure 3:
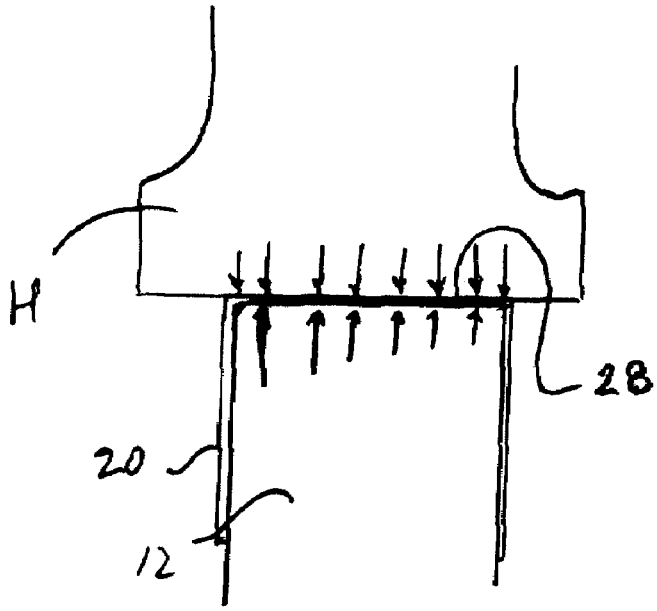
FIG. 3 is a side cutaway view of an end portion of the snow pole illustrated in FIG. 1, illustrating force distribution at the moment of impact.

As seen in FIG. 3, the nail-head surface 28 in combination with the cylindrical wall portion 22, form an effective impact structure to receive hammer blows and distribute the resultant forces effectively. The impact force is substantially evenly transmitted to the pole. FIG. 3 illustrates the even distribution of forces from a hammer blow along the nail-head surface.

Figure 4:
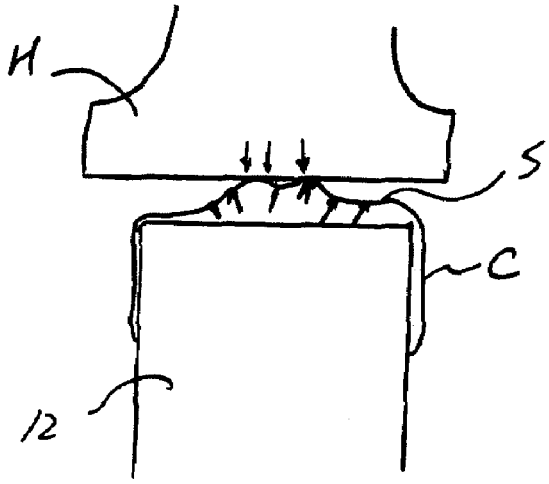
Fig 4 Prior Art
FIG. 4 is a side cutaway view of a prior art snow pole, illustrating force distribution at the moment of impact.

In substantial contrast, and with reference to FIG. 4, a conventional, prior art pole includes a flexible rubber cap having a pronounced conical upper surface and is subjected to a hammer blow. Some of the impact energy of the hammer is lost in deformation of the cover, and the remainder is unevenly transmitted to the pole. Therefore the nail-head of the present invention provides a more useful and effective snow pole.

In operation, a user may take a hammer or other implement to the end cap to drive the pole into snow or into the ground. With the present invention, usually one or two blows are sufficient to make effective use of the snow pole. The high visibility surface enhances the ability for others to see the pole and thus become alert to a hazard. The end cap provides the ability to drive the pole into the snow or ground to the extent that it will typically not blow over or become unstable under adverse circumstances.

By the above, the present invention provides an effective low-cost, lightweight snow pole with the ability to be driven by hammer or other hammering implement.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the description provided herein, the claims appended hereto and the equivalents thereof.

I claim:

1. A Marker Pole consisting of:

no more than two parts;

each of the no more than two parts being formed from materials of substantially constant physical composition throughout their structure and further comprising a comparison of the physical composition of the first part being substantially plastic material and the physical composition of the second part being substantially metal material;

the first part being a generally elongate pole body having substantially no protrusions on the sides thereof;

the pole body having a penetrating end and a distal end, the penetrating end formed with a tapered tip for insertion into a support medium, the distal end being formed to have a generally planar upper surface and further formed in a generally cylindrical profile to receive the second part being a generally undeformable and unbreakable impact cap;

the impact cap having a flat nail head structure;

the impact cap being formed to have a generally cylindrical body having an access opening correspondingly formed to receive the distal end of the pole body on one end thereof, and a substantially planar surface opposing the access opening, the planar surface being in substantial contact with the upper surface of the distal end of the pole body when the impact cap is fitted over the distal end;

upon receiving impact force from a driving implement, the impact cap distributing the impact force evenly over the pole, thereby achieving enhanced efficiency and reduced force transmission sequentially from the driving implement, to the flat nail head structure of the impact cap, to the planar surface of the impact cap, and to the distal end of the pole body during reversible and removable insertion of the marker pole into the support medium when using an impact producing tool; and, upon reversible and removable insertion of the marker pole into the support medium, at least a portion of the pole body being disposed outside of the support medium.

2. A marker pole according to claim 1 wherein the physical composition of the pole body consists of the substantially plastic material being chosen from the group: polymers and fiberglass.

3. A marker pole according to claim 1 wherein the physical composition of the pole body is fiberglass.

4. A marker pole according to claim 1 wherein the substantially plastic material has a physical composition chosen from the group: fluorescent and brightly colored; and being further chosen from the group: present throughout the physical composition and applied to an exterior surface of the generally elongate pole body.

5. A marker pole according to claim 1 wherein the penetrating end of the pole body is formed with a taper greater than forty-five degrees from a centerline longitudinal axis of said pole body.

6. A marker pole according to claim 1 wherein the length of the pole is between about 3 feet and about 4 feet and the width of the pole is between about ¼ inch and about ½ inch.

7. A marker pole according to claim 6 wherein the length of the pole is about 4 feet and the width of the pole is about 5/16 inch.

8. An improvement to a marker pole, the improvement consisting of:

the marker pole consisting of no more than two parts being a first part and a second part;

the first part being a generally elongate pole body having substantially no protrusions on the sides thereof;

the pole body having a penetrating end and a distal end, the penetrating end formed with a tapered tip for insertion into a support medium, the distal end being formed to have a generally planar upper surface and further formed in a generally cylindrical profile to receive the second part being a generally undeformable and unbreakable impact cap;

the impact cap having a flat nail head structure;

the impact cap being formed to have a generally cylindrical body having an access opening correspondingly formed to receive the distal end of the pole body on one end thereof and a substantially planar surface opposing the access opening, the planar surface being in substantial contact with the upper surface of the distal end of the pole body when the impact cap is fitted over the distal end;

upon receiving impact force from a driving implement, the impact cap distributing the impact force evenly over the pole, thereby achieving enhanced efficiency and reduced force transmission sequentially from the driving implement, to the flat nail head structure of the impact cap, to the planar surface of the impact cap, and to the distal end of the pole body during reversible and removable insertion of the marker pole into the support medium when using an impact producing tool; and, upon reversible and removable insertion of the marker pole into the support medium, at least a portion of the pole body being disposed outside of the support medium.

9. An improvement to a marker pole according to claim 8 wherein the physical composition of the pole body is that of a substantially plastic material.

10. An improvement to a marker pole according to claim 9 wherein the substantially plastic material additionally has a physical composition chosen from the group: fluorescent and brightly colored; being further chosen from the group: present throughout the physical composition and applied to an exterior surface of the generally elongate pole body.

11. An improvement to a marker pole according to claim 8 wherein the physical composition of the pole body is that of a substantially plastic material chosen from the group: polymers and fiberglass.

12. An improvement to a marker pole according to claim 8 wherein the physical composition of the pole body is fiberglass.

13. An improvement to a marker pole according to claim 8 wherein the physical composition of the impact cap is that of a substantially metal material.

14. An improvement to a marker pole according to claim 8 wherein the penetrating end of the pole body is formed with a taper greater than forty-five degrees from a centerline longitudinal axis of said pole body.

15. An improvement to a marker pole according to claim 8 wherein the length of the pole is between about 3 feet and about 4 feet and the width of the pole is between about ¼ inch and about ½ inch.

16. An improvement to a marker pole according to claim 15 wherein the length of the pole is about 4 feet and the width of the pole is about 5/16 inch.

* * * * *